US005570907A

United States Patent [19]

Dromi et al.

[11] Patent Number: 5,570,907

[45] Date of Patent: Nov. 5, 1996

[54] PAPER GRIPPING DEVICE

[75] Inventors: Aviva Dromi, P.O.B. 72, Hofit; David Blum, Hadera; Abraham Pick, Kibbutz Moran, all of Israel

[73] Assignees: Aviva Dromi, Hofit; Esther Blum, Hadera, both of Israel

[21] Appl. No.: 338,849

[22] Filed: Nov. 14, 1994

[30] Foreign Application Priority Data

Nov. 15, 1993 [IL] Israel ..... 107618

[51] Int. Cl.[6] ..... B42F 13/42; B42F 9/00

[52] U.S. Cl. ..... 281/45

[58] Field of Search ..... 281/45; 24/67 R, 24/67.3, 67.5, 67.7, 67.9, 67.11

[56] References Cited

U.S. PATENT DOCUMENTS

| | | | |
|---|---|---|---|
| 895,268 | 8/1908 | Heydemann | 24/67.7 |
| 3,827,109 | 8/1974 | Langwell | 24/67.5 |
| 3,905,068 | 9/1975 | Numazu et al. | 24/67.5 |
| 3,982,307 | 9/1976 | Smith et al. | 24/543 |
| 4,086,686 | 5/1978 | Takabayashi | 24/250 |
| 4,557,503 | 12/1985 | Linn | 281/47 |
| 4,790,680 | 12/1988 | Givati et al. | 402/500 X |
| 4,989,298 | 2/1991 | Wang | 24/67 R |
| 5,169,255 | 12/1992 | Jensen | 402/80 R |

FOREIGN PATENT DOCUMENTS

| | | | |
|---|---|---|---|
| 2264142 | 8/1993 | United Kingdom | 281/45 |

*Primary Examiner*—Frances Han

*Attorney, Agent, or Firm*—Dennison, Meserole, Pollack & Scheiner

[57] ABSTRACT

A device for clamping together a plurality of loose leafs including first and second clamp members arranged in a jaw-like arrangement; force responsive closure apparatus for closing the first and second clamp members together in response to an externally applied closure force so as cause the first and second clamp members to enclose therebetween a selected plurality of loose leafs and so as to apply a clamping force thereto; and releasable locking apparatus for selectably locking the first and second clamp members together in clamping engagement with the plurality of loose leafs.

9 Claims, 6 Drawing Sheets

PAPER GRIPPING DEVICE

FIELD OF THE INVENTION

The present invention relates to apparatus for releasably gripping or clamping together a plurality of loose leafs such as filed in a loose-leaf type binder, so as to facilitate temporary removal therefrom.

BACKGROUND OF THE INVENTION

In the present specification, the term "loose leafs" is used to mean any plurality of flexible sheets that may be used or stored together in a generally flattened arrangement, such as sheets of paper. It will, of course be understood, that where the term "papers" is used, this is also intended to include other paper-like sheets.

There have long been known in the art devices, such as paper clips, for clipping together a number of papers. A particular problem arises with regard to clipping together a number of loose-leaf pages which have been inserted into a loose-leaf binder or file folder. In this case, papers are generally punched and thereafter filed in a desired order. If it is necessary to remove one or more selected pages from within a stack of pages filed in the loose-leaf binder or file folder and then restore to the file the pages originally located above the selected pages,, the pages which were filed after the selected pages must be removed before the selected pages can be removed, and then replaced in the folder in the same order after the selected pages have been either permanently removed or refiled.

The most common filing method involves punching two holes in one edge of the pages to be filed. The punched pages are then inserted through a fastener, generally comprising two bendable prongs, the base of which is secured to the folder by passing the prongs outwardly through two holes punched in a flap which is an integral part of the folder. The filed pages may be secured by either bending the protruding portions of the prongs against the top page, or against a retaining device which comprises two holes for inserting the prongs and two sliding retainers for retaining the bent prongs.

Removal of pages from this fastener requires sliding the retainers (in case a retaining device is being used), straightening the bent portions of the prongs and sliding the pages therealong. Replacement of the removed pages requires sliding them through the punched holes back onto the prongs. Thus, removal and reinsertion of punched pages in a file folder of this kind is often time consuming and tedious, especially when said selected pages are located near the bottom of the stack of pages filed in the folder and the pages must be removed and reinserted one by one.

A number of solutions to this problem have been proposed. These include devices such as those disclosed in U.S. Pat. Nos. 5,169,255, 895,268 and 4,790,680 which are designed to grip the pages above the selected pages and to hold them as a single unit while they are removed, to permit removal of the selected pages, and replaced thereafter. These devices are all spring biased in the closed or gripping orientation, requiring application of a force by a user so as to open them in order to permit the insertion therein of papers.

These devices all suffer from the disadvantage that the strength of gripping is limited to the spring which biases the device which, in turn, limits the number of pages which can be tightly gripped by the device. Thus, if the number of pages to be gripped is relatively large, these devices are unable to grip them firmly, and the pages tend to move relative to one another during removal and replacement.

SUMMARY OF THE INVENTION

It is an object of the present invention to provide a loose leaf clamp for clamping together a variable number of pages, in particular during removal from a file folder and replacement therein, which does not suffer from disadvantages of the prior ark.

There is thus provided in accordance with the present invention a device for clamping together a plurality of loose leafs including:

first and second clamp members arranged in a jaw-like arrangement;

force responsive closure apparatus for closing the first and second clamp members together in response to an externally applied closure force so as cause the first and second clamp members to enclose therebetween a selected plurality of loose leafs and so as to apply a clamping force thereto; and releasable locking apparatus for selectably locking the first and second clamp members together in clamping engagement with the plurality of loose leafs.

Additionally in accordance with the present invention, there is also provided apparatus for biasing apart the first and second clamp members in a normally open position.

Further in accordance with the present invention, there is further provided apparatus for releasing the locking apparatus such that, in the absence of the externally applied closure force, the biasing apparatus is operative to cause the first and second clamp members to return to an open position.

Additionally in accordance with the present invention, there is also provided force multiplying apparatus for multiplying the closure force such that the clamping force is greater than the closure force.

In accordance with an alternative embodiment of the invention, one of the first and second clamp members is a resilient member which, in the absence of a closure force, has an at-rest position wherein the resilient member is spaced apart from the other clamp member, and wherein the resilient member is operative to move generally towards the other clamp member in response to application of a closure force, and is further operative, upon release of the locking apparatus and in the absence of a closure force, to return to the at-rest position.

There is further provided, in accordance with a further preferred embodiment of the invention, a method of clamping together a plurality of loose leafs including the steps of:

placing about a plurality of loose leafs that is sought to clamp together a pair of clamp members in a jaw-like arrangement;

applying an external closure force to the first and second clamp members so as to close them together, thereby to apply a clamping force to the plurality of loose leafs; and locking the first and second clamp members together in clamping engagement with the plurality of loose leafs.

Additionally in accordance with the present invention, the method also includes the step of biasing apart the first and second clamp members in a normally open position.

Further in accordance with the present invention, the method also includes the step of multiplying the closure force such that the clamping force is greater than the closure force.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a device for clamping together a variable number of loose-leafs or sheets of paper or the like, thereby to prevent relative movement from occurring between the leafs or sheets. This device is particularly useful for clamping together pages to be removed temporarily from a loose-leaf binder or file folder and to be replaced therein.

It is a particular feature of the invention that the device does not have biasing means which maintains it in a closed position, and against which a force has to be applied in order to open the device so as to permit insertion therein of papers, as per the prior art. Rather, the present device requires application by a user solely of a closure force, i.e. that which causes closure of the clamping device, and wherein a clamping force applied is proportionate to the closure force applied.

It is thus a feature that the device is lockable in any of a plurality of closed orientations, the precise closed orientation depending on the closure force applied by the user and the number of pages being clamped together. A locking mechanism is provided to lock the device in the final closed orientation so as to clamp the loose leafs together until released by that the closure force need not be maintained manually.

In some embodiments of the invention, there is also provided biasing means, such that the device reverts to a normally open at-rest position in the absence of a closure or locking force. In this embodiment, as the device of the invention is normally open, removal of a closure or locking force causes unclamping of the loose leafs or pages, thereby permitting removal thereof.

Figure 1:
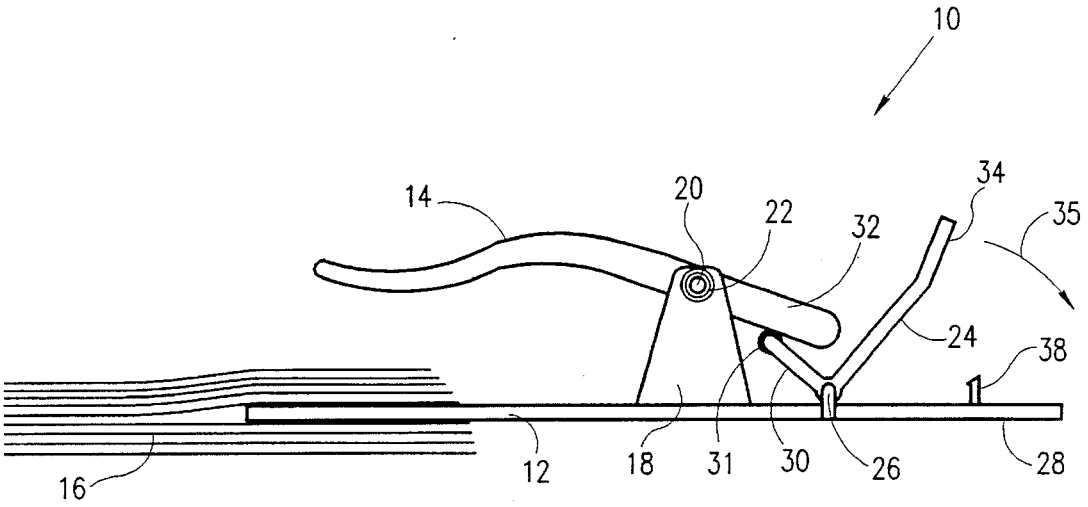
FIG. 1 is a schematic side view of a loose leaf clamping device constructed and operative in accordance with an embodiment of the present invention, in an open orientation.
Figure 2:
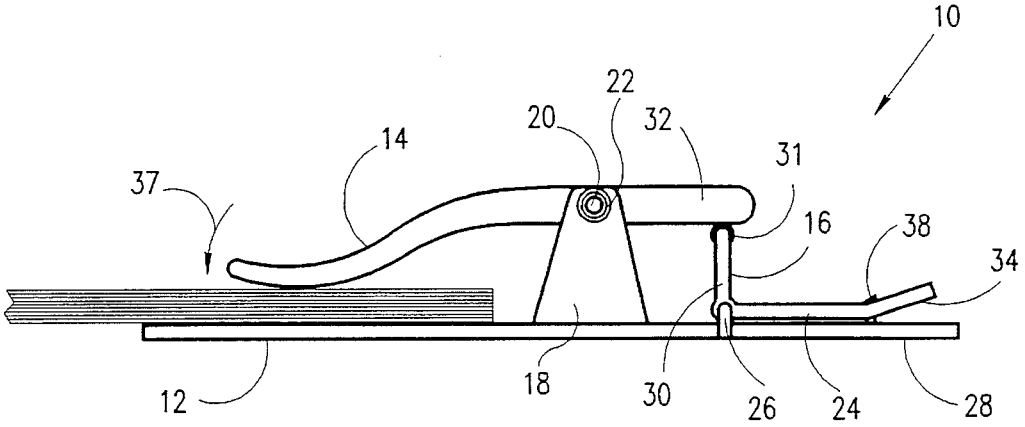
FIG. 2 is a schematic side view of the device of FIG. 1 in a closed orientation.

Referring now to FIGS. 1 and 2 there is shown in schematic side view a paper clamping device 10 constructed and operative in accordance with an embodiment of the invention. The device 10 includes a first clamp member 12 and a second clamp member 14. First clamp member 12 is preferably a substantially planar member, having a configuration such as that of first clamp member 72 as shown and described hereinbelow in conjunction with the embodiment of FIG. 5.

First clamp member 12 is thus suitable for insertion into a plurality of loose leafs or paper sheets 16 mounted onto a common storage system (not shown), such as a file or binder as described above. Second clamp member 14 is configured for effective frictional gripping of a variable number of pages; accordingly, it may be S-shaped or have any other suitable shape for this purpose. Preferably second clamp member 14 is not planar.

First and second clamp members 12 and 14 are coupled together in a generally jaws-like arrangement, via a pivot mounting 18 through which extends a pivot axis 20. A biasing member 22, such as a spring, may also be provided such that clamp members 12 and 14 have a normally open position.

A closure member or lever, referenced 24, is pivotably mounted, as seen at 26, onto a rearward extension 28 of first clamp member 12. Member 24 has a front end 30 onto which is mounted a low friction element 31, such as a roller. Low friction element 31 engages a rearward extension 32 of second clamp member 14, so as to transfer a direct force thereto.

As a generally downward closure force is applied to a rear end portion 34 of lever 24, as shown in FIG. 1 by arrow 35, lever front end 30 and low friction element 31 force rearward extension 32 of second clamp member 14 to rotate in an opposite sense to the direction of rotation of lever 24, thereby causing a front end portion 36 of second clamp member to press down onto the loose leafs 16, thereby to forcibly retain or clamp the plurality of loose leafs between the first and second clamp members. This is shown schematically by an arrow 37 in FIG. 2.

A particular feature of the invention, which is present not only in the present embodiment but also in those described hereinbelow in conjunction with FIGS. 3–8, is that of "force multiplication," whereby, in order to obtain a relatively high magnitude clamping force, such that the loose leafs being clamped do not move relative to each other, only a relatively small magnitude closure force is required. Force multiplication is provided by provision of a lever arm, the magnitude of the force multiplication provided being dependent on the physical length of a lever, shown, in the present embodiment, at reference numeral 24, and on the precise force location application position along the lever. This physical phenomenon is well known per se and does not therefore require further explanation. This phenomenon is also not described hereinbelow on conjunction with the embodiments of FIGS. 3–8, but is an inherent feature of each embodiment employing a lever member to operate the closure apparatus or as a part thereof.

As seen, there is also provided a locking element 38, seen in the drawing as a hook member, by which rear end portion 34 of lever 24 may be locked to rearward extension 28 of first clamp member 12. Loose leafs 16 remain clamped in device 10 until lever 24 is released from locking element 38, whereupon second clamp member 14 may be manually raised to an open position. In the event that biasing member 22 is provided, second clamp member 14 is raised automatically to an open position.

Figure 3:
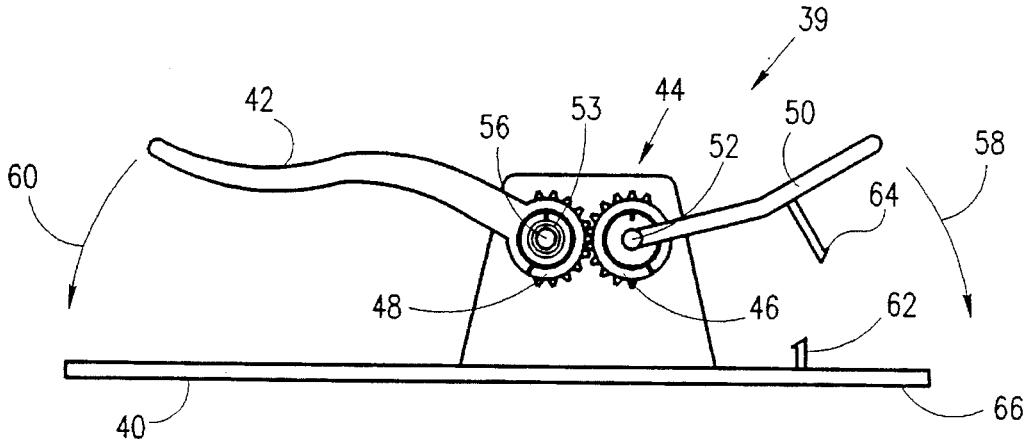
FIG. 3 is a schematic side view of a paper clamping device constructed and operative in accordance with another embodiment of the present invention, in an open orientation.
Figure 4:
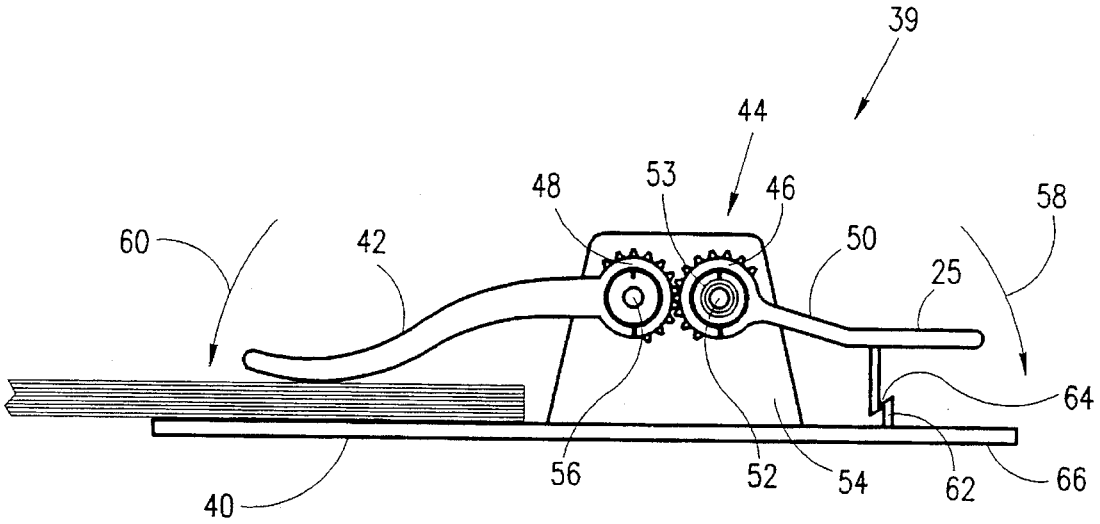
FIG. 4 is a schematic side view of the device of FIG. 3 in a closed orientation.

Referring now to FIGS. 3 and 4 there is shown in schematic side view a clamping device, referenced generally 39, constructed and operative in accordance with another embodiment of the invention, in respective open and closed orientations. The device includes a first clamp member 40, which is similar to first clamp member 12 (FIGS. 1 and 2), and a second clamp member 42. Second clamp member 42 is generally similar to second clamp member 14 of device 10 (FIGS. 1 and 2), except as described hereinbelow.

In the present embodiment, there is provided a closure mechanism, referenced generally 44, which includes a pair of meshing first and second gear wheels 46 and 48, and a lever member 50. First gear wheel 46 is arranged to pivot together with lever member 50 about a first pivot axis 52 extending through a mounting member 54 attached to first clamp member 42, and second gear wheel 48 is arranged to pivot together with second clamp member 42 about a second pivot axis 56, also extending through mounting member 54, parallel to first pivot axis 52.

Typically, lever member 50 and first gear wheel 46 are formed from a single portion of a suitable plastic or metal, for example, and, similarly, second clamp member 42 and second gear wheel 48 are also formed from a single portion of a suitable plastic or metal, for example. Optionally, a biasing member 53 may be provided in association with either of the gearwheels 46 and 48. Thus by way of example, biasing member 53 is seen in FIG. 3 to be associated with second gear wheel 48, being mounted about second pivot axis 56, while in FIG. 4, biasing member 53 is seen to be associated with first gearwheel 46, being mounted about pivot axis 52. The operation of biasing member 53 is similar to that of biasing member 22 in the embodiments of FIGS. 1 and 2, and is thus not specifically described herein.

As the two gearwheels 46 and 48 are positioned in meshing association, a rotation of lever member 50 causes a corresponding rotation of second clamp member 42, and vice-versa. Accordingly, rotation of lever member 50 so as to lower it, as indicated by arrow 58, causes a corresponding lowering of second clamp member 42, as indicated by arrow 60, thereby to clamp loose leafs 16 between the two clamp members. A pair of selectably interlockable pawl members 62 and 64 are provided on a rearward extension 66 of first clamp member 42 and lever member 50, respectively, thereby facilitating locking of device 39 in a closed position, substantially as described in conjunction with device 10 above.

Figure 5:
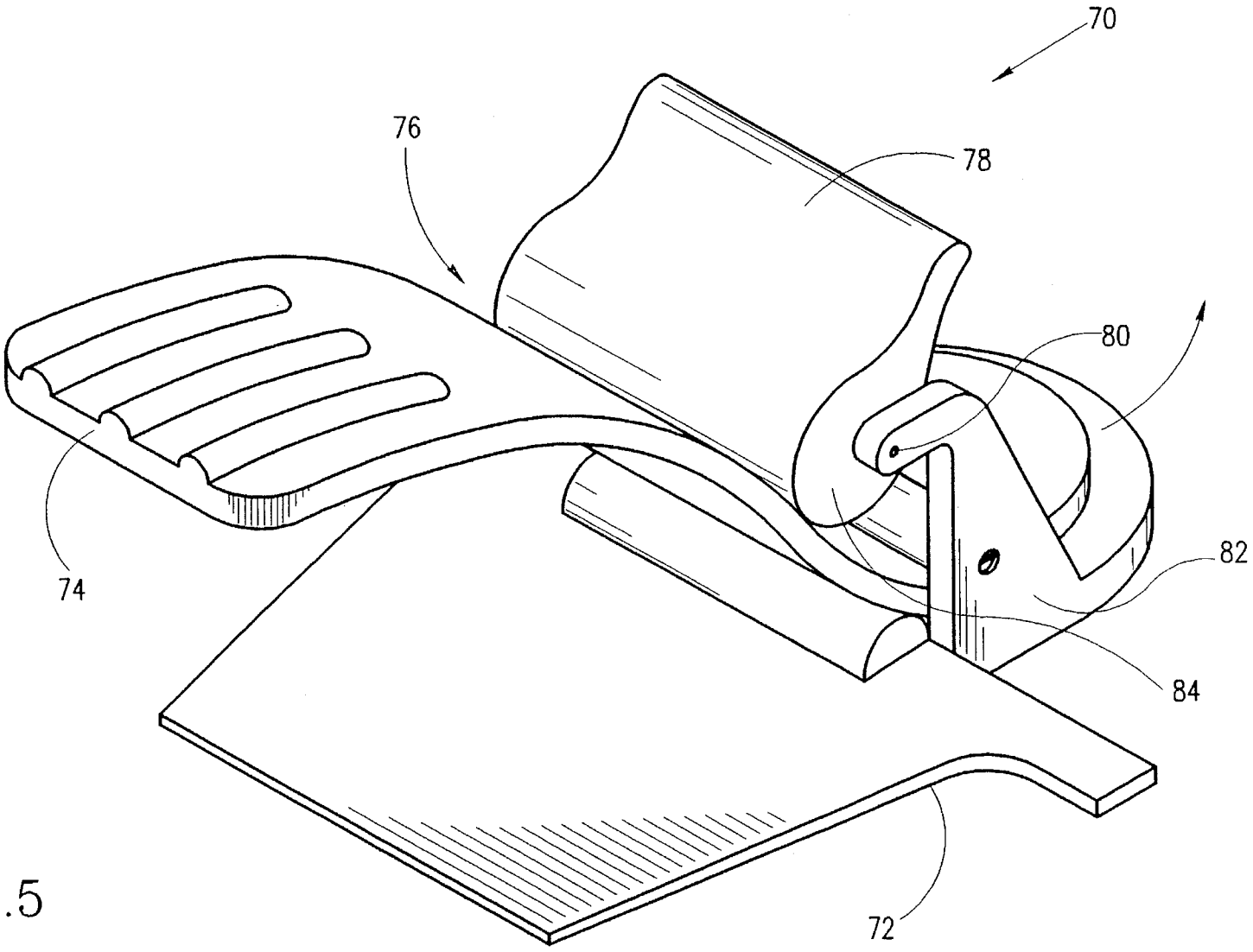
FIG. 5 is a perspective view of a paper clamping device constructed and operative in accordance with yet a further embodiment of the present invention.

Referring now to FIG. 5, there is shown in perspective view a paper clamping device, referenced generally 70, constructed and operative in accordance with yet another embodiment of the invention. This embodiment comprises a first clamp member 72 and a second clamp member 74 coupled to one another by a closure mechanism 76.

In the illustrated embodiment, the closure mechanism 76 includes a lever member 78 which is eccentrically mounted about a pivot axis 80 extending through a pivot mounting 82 mounted onto a rearward extension of first clamp member 72. It is seen that lever member 78 is not coupled to second clamp member 74. Lever member 78 includes, however, an eccentric cam portion 84 which is operative, when lever member 78 is rotated by application thereto of a closure force, to displace second clamp member 74 in a generally downward direction, towards first clamp member 72, such that a clamping force is applied thereby to the loose leafs therebetween.

Figure 6:
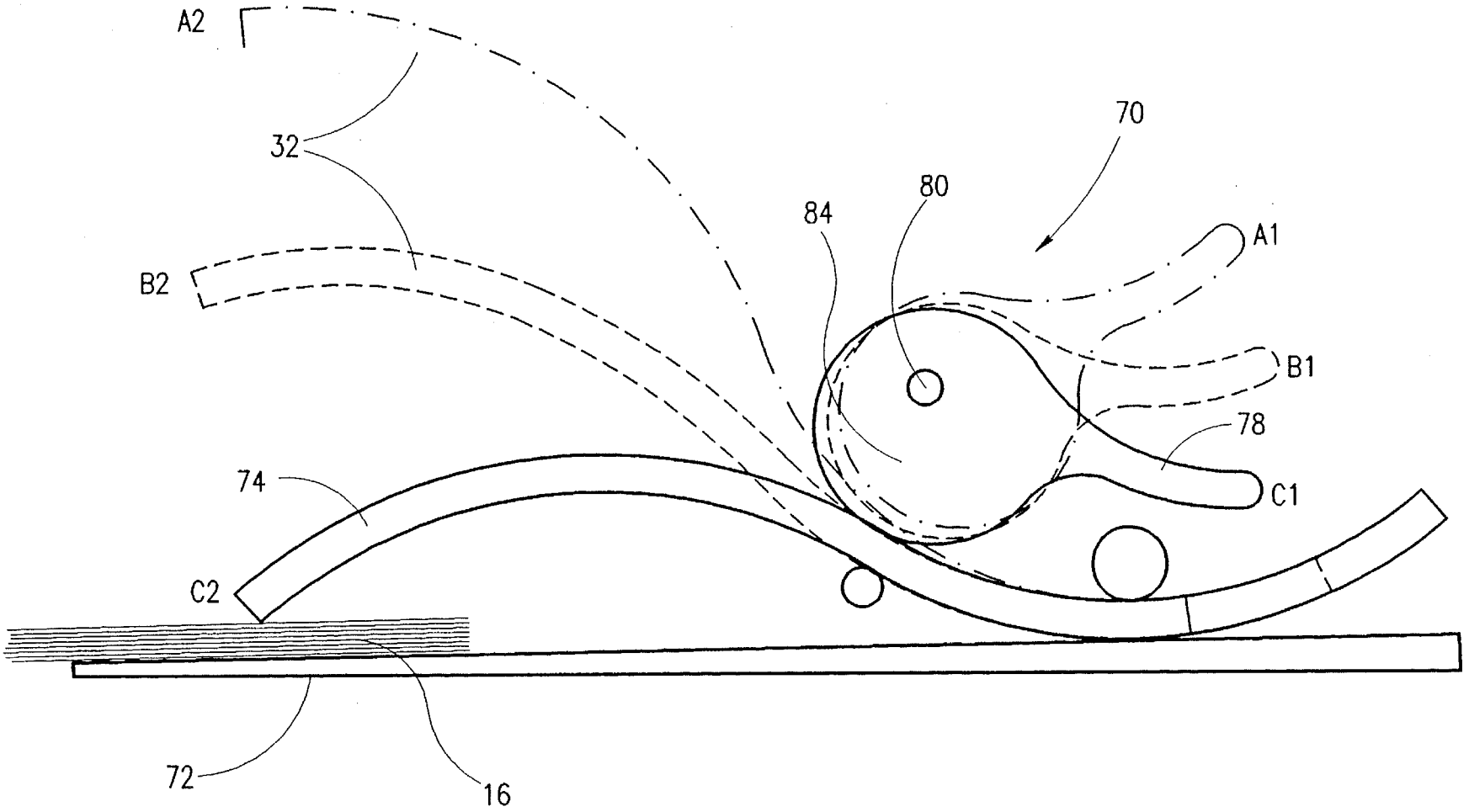
FIG. 6 is a diagrammatic side view illustration of various operative orientations of the device of FIG. 5 in operation.

As seen in FIG. 6, pivoting of lever member 78 from a first position A1, through a second, intermediate position B1, to a third position C1, causes a corresponding rotation of second clamp member 74 from a first position A2, through a second, intermediate position B2, to a third position C3, whereat loose leafs 16 located between the clamp members become clamped therebetween.

It will be appreciated that lever member 78 and second clamp member 74 remain substantially locked in place due to frictional forces between cam portion 84 and second clamp member 74, the cam portion and second clamp member thus constituting a locking mechanism. Pivoting of lever member 78 in an opposite direction causes removal of the clamping force therefrom and permits removal of the loose leafs from the device.

Figure 8:
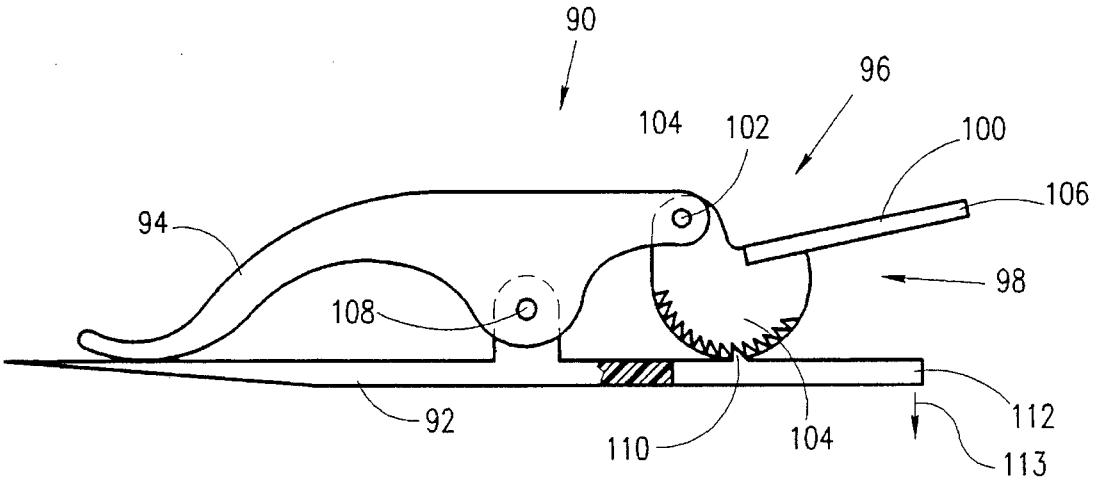
FIG. 8 is a partially cut-away side view of the device of FIG. 7.
Figure 7:
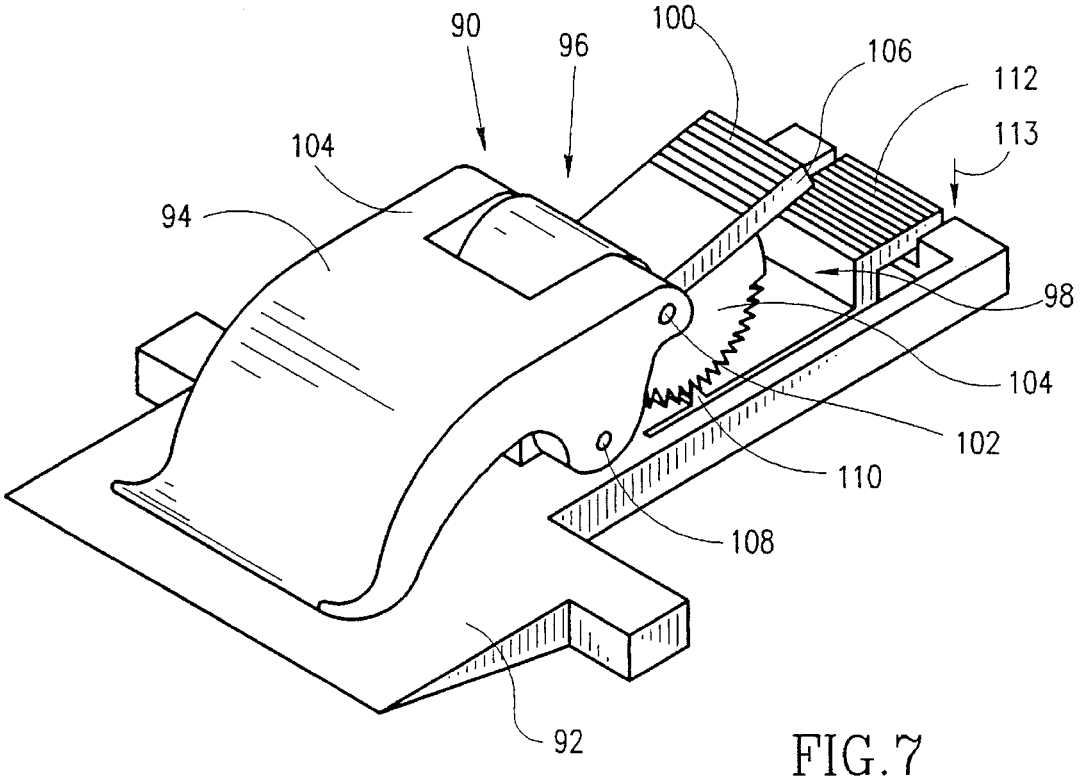
FIG. 7 is a perspective view of a paper clamping device constructed and operative in accordance with another embodiment of the present invention.
Figure 10A:
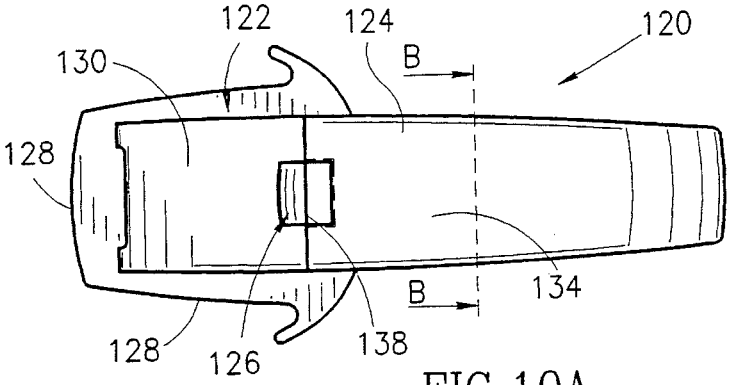
FIG. 10A is a top view of the clamping device of FIGS. 9A and 9B.
Figure 10B:
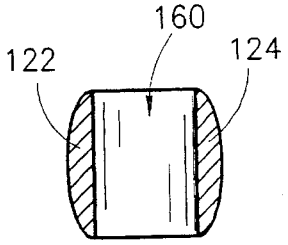
FIG. 10B is a sectional view of the clamping device of FIG. 10A, taken along line B—B therein.

With reference to FIGS. 7 and 8 there is shown a loose leaf clamping device, referenced 90, constructed and operative in accordance with a further embodiment of the invention. The present embodiments generally similar to other embodiments shown and described above, having first and second clamp members 92 and 94, a force responsive closure mechanism 96 and a locking mechanism 98. The following description of the present embodiment thus relates mainly to the detailed structure of the closure and locking mechanisms.

As seen in the drawings, the closure mechanism 96 is constituted by a lever member 100 mounted for pivoting about a pivot axis 102 extending through a rear portion 104 of second clamp member 94. Lever member 100 has a curved toothed portion 104 and a handle 106 for rotating the entire lever member, and thus also the curved toothed portion 104. The second clamp member 94 pivots about an axis 108 so as to serve as a force transfer element, transferring an externally applied closure force to a clamping force, applied by the clamp members to the loose leafs.

A one-way locking tooth 110 engages toothed locking portion 104 so as to provide interim locking at progressive stages during the closure and clamping process. In other words, once the lever member 100 has been displaced downwardly, towards first clamp member 92, and the second clamp member 94 tightened against the loose leafs being held, second clamp member 94 applies to the looses leafs a clamping force. This clamping force is maintained until the locking tooth 110 is disengaged from curved toothed portion 104.

Accordingly, as seen in the drawings, locking tooth 110 is mounted onto a flexible release element 112, a downward displacement of which, indicated by an arrow 113, causes disengagement of locking tooth 110 from curved toothed portion 104. A subsequent release of the release element 112 permits return of locking tooth 110 into locking engagement with curved toothed portion 104.

It will be appreciated that although curved toothed 104 is illustrated as being eccentric, a non-eccentric toothed wheel may alternatively be employed.

It will be appreciated by those skilled in the art that the second clamp member or the lever member in the above-described devices—even where not specifically described—can be spring-biased in the open orientation. Alternatively, the upper second clamp member can be formed of a sufficiently elastic material that, while it is strong enough to apply substantial pressure to papers held therein, it is flexible enough to bias itself in the open orientation.

Referring now to FIGS. 9A–10B, there is seen a loose leaf clamping device, referenced generally 120, constructed and operative with yet a further embodiment of the invention.

Device 120 is typically formed from two portions, a clamp portion which defines first and second clamp members, respectively referenced 122 and 124, and a locking portion 126. Typically, either or both of the clamp and locking portions are formed from a single portion of a suitable type of molded plastic.

A front portion 128 of first clamp member 122 is generally flat so as to be easily insertable into a bundle 129 of loose leafs, and a front portion 130 of second clamp member typically has a generally arcuate configuration. This configuration of front portion 130, together with its inherent flexibility, enables application of a clamping force thereby to the top 132 of bundle 129 when the two clamp members are forced together. Preferably, closure of the two clamp members together is provided by squeezing between the thumb and remaining digits of a single hand, a thumb being operative to squeeze on a central press portion 134 of second clamp member 124, as indicated by arrow 136 in FIG. 9A.

It is thus appreciated that squeezing together of first and second clamp members 122 and 124, and in particular of the front portions 128 and 130 thereof, provides closure of device 120. Locking of device 120 in a clamping position, however, is provided via the locking portion, referred to from here on as "first locking member 126," which is mounted into an opening 138 formed in second clamp member 124, and a second locking member 140, formed integrally with first clamp member 122.

Figure 9A:
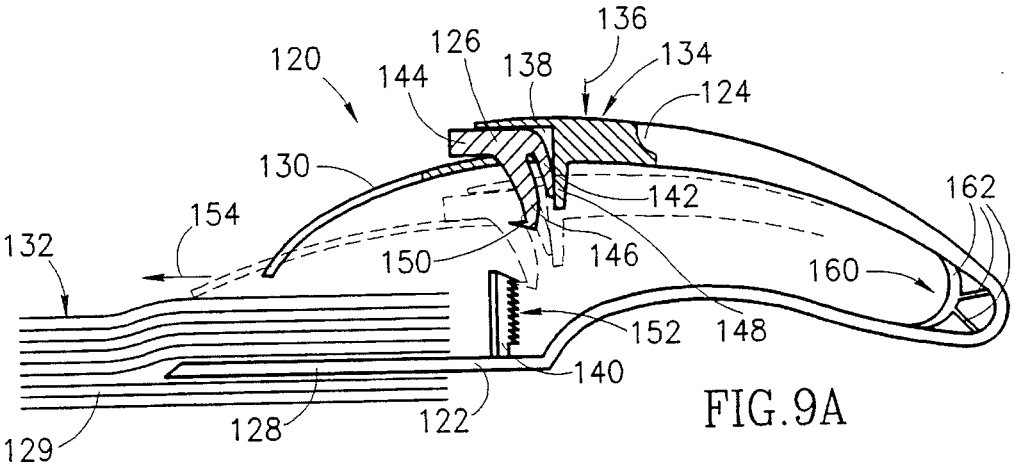
FIG. 9A is a side-sectional view of a further clamping device, constructed and operative in accordance with the present invention, in a first, open orientation and in a second, closed and locked orientation.
Figure 9B:
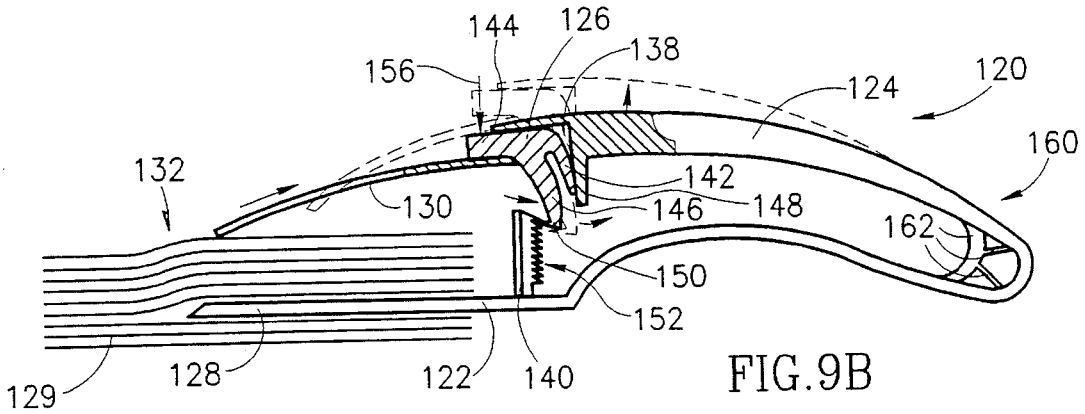
FIG. 9B is a side-sectional view of the device of FIG. 9A in the second orientation and in a third, unlocked orientation.

As seen in FIGS. 9A and 9B, first locking member 126 has a generally hammerhead-like configuration, having a curved, flexible, rear portion 142, a front lever portion 144 and a transversely extending locking portion 146. Member 126 is mounted in opening 138 of second clamp member 124 such that curved rear portion 142 is engaged with a transversely extending projecting portion 148 of the second clamp member 124, and such that rear portion 142 normally urges first locking member into a position of engagement with second locking member 140.

Locking portion 146 of first locking member 126 has formed thereon a tooth 150, which is configured to interlock with a plurality of teeth 152 formed on second locking member 140.

Referring now particularly to FIG. 9A, device 120 is shown, in solid lines, in an initial or "at-rest" position, wherein first clamp member 120 has been inserted beneath plurality of loose leafs that it is sought to clamp. In order ho close device 120, a generally downward force is exerted on press portion 134, as shown by arrow 136, thereby moving second clamp member 124 to a closed position, shown by broken lines. As device 120 is closed, as described, front portion 130 of second clamp member 124 deforms so as to spread outwardly, as indicated by arrow 154, taking up a final position that is determined in accordance with the thickness of the bundle of loose leafs being clamped and the clamping force transferred by the second clamp member to the bundle.

A further result of the closing force applied to the second clamp member 124 is that first locking member 126 is also displaced downwardly, into locking engagement with second locking member 140.

Device 120 employs biasing apparatus, referenced generally 160, such that the device is a normally-open device, such that, when it is unlocked, and in the absence of a closure force, the device reverts to its normally open orientation, as seen in full lines in FIG. 9A, and in broken lines in FIG. 9B. In the present embodiment, biasing apparatus 160 includes resilient rib members 162, formed integrally with the clamp members 122 and 124. Alternatively, however, the required biasing may be provided by forming either or both of the clamp members 122 and 124, or a connection therebetween, in the event that they are not integrally formed, to be inherently elastic or resilient.

Referring now to FIG. 9B, in order to release the device 120, the respective interlocked teeth of the first and second locking members 126 and 140 are disengaged by pressing down on front lever portion 144 of first locking member 126, as shown by arrow 156. This causes a partial rotation of first locking member 126, including the transverse locking portion 146, as seen by arrows 158, thereby causing disengagement of tooth 150 of portion 146 from teeth 152 of second locking member 140. Immediately upon disengagement, device 120 springs open such that second clamp member returns from the full-line position seen in FIG. 9B to the normally open, at rest position, shown by broken lines.

It will be appreciated by persons skilled in the art that the invention is not limited to what has been shown and described hereinabove by way of example. Rather, the scope of the invention is limited solely by the claims which follow.

We claim:

1. A resilient sheet clamping device for retaining a plurality of stacked sheets in a predetermined orientation including a generally planar base member defining a first clamping component and supporting a generally curvilinear second clamping component thereabove for movement between clamping and unclamping positions; said second clamping component including a sheet engaging portion and an actuating portion including a first locking means; means for applying actuating forces to said actuating portion mounted on said base and responsive to the application of actuating forces to move said second clamping component toward said first clamping component and into clamping engagement with said sheets which creates a clamping force; and second locking means carried on said first clamping component for securing said clamping components in locked relation when interengaged with said first locking means.

2. A device according to claim 1 and also comprising means for biasing apart said first and second clamping components in a normally open position.

3. A device according to claim 2, and also comprising means for releasing said first and second locking means such that, in the absence of said externally applied actuating force, said biasing means is operative to cause said first and second clamping components to return to an open position.

4. A device according to claim 2, and wherein said means for biasing apart comprises resilient means.

5. A device according to claim 4, and wherein at least one of said first and second clamping components is a resilient member which, in the absence of an actuating force, has an at-rest position wherein said resilient member is spaced apart from the first of said clamping components, and wherein said resilient member is operative to move generally towards the first of said clamping components in response to application of an actuating force, and is further operative, upon release of said first and second locking means and in the absence of an actuating force, to return to said at-rest position.

6. A device according to claim 1 and also comprising force multiplying means for multiplying the actuating force such that the clamping force is greater than the actuating force.

7. A device according to claim 1 and wherein said first clamping component comprises a generally flat planar portion configured for selectable insertion between two adjacent loose leafs in a plurality of loose leafs commonly mounted in a storage system.

8. A device according to claim 1, and wherein said second clamping component is mounted for rotation about a rotation axis having a fixed position relative to said first clamping component, and wherein said actuating portion comprises means for rotating said second member towards said first clamping component, thereby to clamp therebetween the plurality of loose leafs.

9. A device according claim 1 and wherein at least said first and second clamping component are formed from a single portion of material.

* * * * *